US008189804B2

(12) United States Patent
Hruza

(10) Patent No.: US 8,189,804 B2
(45) Date of Patent: May 29, 2012

(54) SOUND PROVIDER ADAPTER TO CANCEL OUT NOISE

(75) Inventor: Eric Hruza, Plymouth, MN (US)

(73) Assignee: Sonion Nederland B.V., Amsterdam (NL)

( * ) Notice: Subject to any disclaimer, the term of this patent is extended or adjusted under 35 U.S.C. 154(b) by 703 days.

(21) Appl. No.: 12/337,480

(22) Filed: Dec. 17, 2008

(65) Prior Publication Data

US 2009/0161895 A1 Jun. 25, 2009

Related U.S. Application Data

(60) Provisional application No. 61/015,029, filed on Dec. 19, 2007.

(51) Int. Cl.
*H04R 1/10* (2006.01)
*H04R 25/00* (2006.01)

(52) U.S. Cl. ..... 381/74; 381/317; 381/318; 381/23.1; 381/312; 381/334

(58) Field of Classification Search ..... 381/23.1, 381/312, 317, 318, 328, 72, 74, 334, 174, 381/130, 322, 324
See application file for complete search history.

(56) References Cited

U.S. PATENT DOCUMENTS

| | | | | |
|---|---|---|---|---|
| 4,833,719 | A * | 5/1989 | Carme et al. | 381/72 |
| 5,675,658 | A * | 10/1997 | Brittain | 381/72 |
| 5,862,234 | A * | 1/1999 | Todter et al. | 381/71.6 |
| 6,068,589 | A * | 5/2000 | Neukermans | 600/25 |
| 6,445,799 | B1 * | 9/2002 | Taenzer et al. | 381/71.6 |
| 7,983,433 | B2 * | 7/2011 | Nemirovski | 381/318 |
| 2006/0133636 | A1 * | 6/2006 | Harvey et al. | 381/380 |

OTHER PUBLICATIONS

Widrow et al. Adaptive Noise Cancelling: Principles and Applications. Proceedings of the IEEE, vol. 63, No. 12, 1975, pp. 1692-1975.*

* cited by examiner

*Primary Examiner* — Colleen Matthews
*Assistant Examiner* — Galina Yushina
(74) *Attorney, Agent, or Firm* — Nixon Peabody LLP

(57) ABSTRACT

A sound provider for providing sound to a person's ear includes one or more terminals for receiving a first electrical signal and a first sound emitter operatively connected to the one or more terminals for outputting a sound corresponding to the first electrical signal. The sound provider also includes a sound receiver for receiving sound and outputting a corresponding, second, electrical signal, and a second sound emitter operatively connected to the sound receiver for outputting a sound corresponding to the second electrical signal.

8 Claims, 1 Drawing Sheet

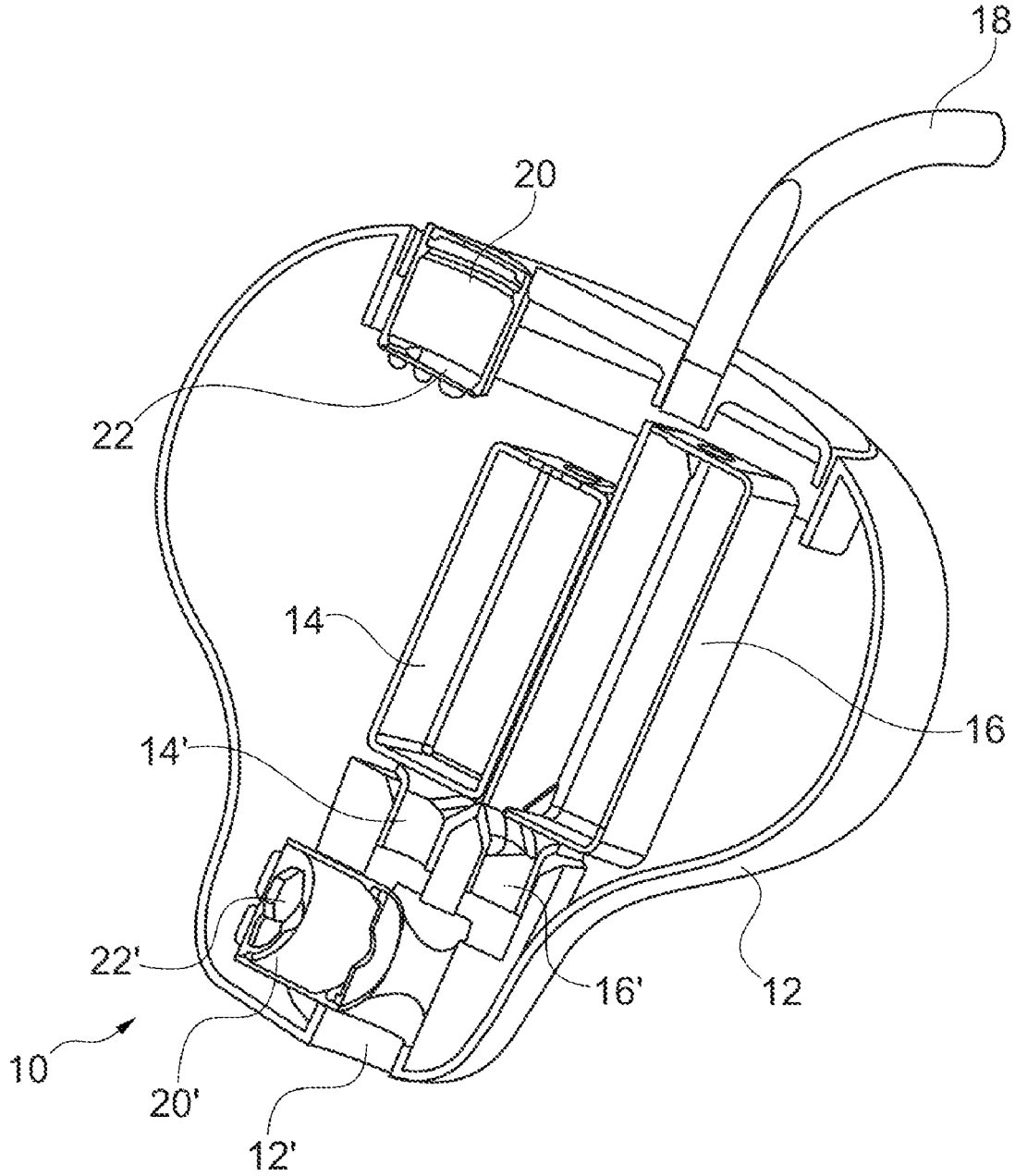
18
20
22
14
16
14'
22'
16'
12
10
20'
12'

SOUND PROVIDER ADAPTER TO CANCEL OUT NOISE

RELATED APPLICATION

This application claims the benefit of priority of U.S. Provisional Patent Application No. 61/015,029, filed Dec. 19, 2007, which is incorporated by reference in its entirety herein.

FIELD OF THE INVENTION

The present invention relates to noise cancellation and in particular to a sound provider having a separate sound emitter for active noise cancellation.

BACKGROUND OF THE INVENTION

The present invention was derived during a project acting to better cancel noise when listening to music, speech or the same in a noisy environment.

Normally, a noise cancelling sound provider has a sound receiver used for determining the noise and a single sound emitter which emits a combined signal comprising both the noise-cancelling sound and the desired sound.

In this project, it was found that in particular in a high noise SPL environment, the sound emitter would overload and output distorted sound. Environments of this type may be that of musicians, drivers/pilots, construction workers, firemen, police officers, soldiers, or the like. In this situation, not only the noise-cancelling sound is distorted due to the high sound level but also the desired sound.

SUMMARY OF THE INVENTION

One aspect of the invention relates to a sound provider for providing sound to a person's ear, the provider comprising one or more terminals for receiving a first electrical signal, a first sound emitter operatively connected to the terminals for outputting a sound corresponding to the first electrical signal, a sound receiver for receiving sound and outputting a corresponding, second, electrical signal, and a second sound emitter operatively connected to the sound receiver for outputting a sound corresponding to the second electrical signal.

In one embodiment, the sound provider further comprises a housing, the first and second sound emitters being positioned so as to output the sound from the housing, and the sound receiver being positioned so as to receive sound from a vicinity of the housing.

In another embodiment, the housing has a first part and a second part, the first part being adapted to face the ear canal of the person and the second part being adapted to face the surroundings of the person, the first part comprising a sound output for outputting the sound from the first and second sound emitters and an opening for receiving sound for reception of the sound receiver. Naturally, the receiving opening and the emitting opening may be the same opening in the housing in order to, for example, facilitate production thereof.

The above summary of the present invention is not intended to represent each embodiment or every aspect of the present invention. The detailed description and FIGURE will describe many of the embodiments and aspects of the present invention.

BRIEF DESCRIPTION OF THE DRAWINGS

The present invention will now be explained in greater detail with reference to the accompanying FIGURE.

FIG. 1 illustrates a cross section of a preferred embodiment according to the invention illustrating two different positions of the sound receiver.

While the invention is susceptible to various modifications and alternative forms, one specific embodiment has been shown by way of example in the appended FIGURE and will be described in detail herein. It should be understood, however, that the invention is not intended to be limited to the particular form illustrated or disclosed. Rather, the invention is to cover all modifications, equivalents, and alternatives falling within the spirit and scope of the invention as defined by the appended claims.

DETAILED DESCRIPTION OF THE INVENTION

In FIG. 1, a sound provider in the form of an ear plug 10 is shown, which may be a hearing aid or a monitor for use by musicians, operators of large machines, chauffeurs, or the like. The sound provider provides sound to a person's ear and comprises, as described below, one or more terminals for receiving a first electrical signal, a first sound emitter operatively connected to the terminals for outputting a sound corresponding to the first electrical signal, a sound receiver for receiving sound and outputting a corresponding, second, electrical signal, and a second sound emitter operatively connected to the sound receiver for outputting a sound corresponding to the second electrical signal. Thus, a separate sound emitter is used for providing the sound corresponding to the second electrical signal.

As shown in the example of FIG. 1, the ear plug 10 has a housing 12 comprising two sound emitters 14 and 16.

The housing 12 receives an electrical signal via a cable 18, which signal is provided to the sound emitter 16 which will output a corresponding sound from a spout 16' and via an opening 12' in the housing.

It is seen in FIG. 1 that the opening 12' is provided in a lower, narrower part of the housing 12 which is adapted to abut against the ear canal of a person or to be provided in the ear canal of a person.

In the opposite, upper end, a first position of the sound receiver 20 is provided, which is adapted to receive or detect sound from the surroundings of the housing 12 and the person wearing the ear plug 10. This receiver 20 outputs an electrical signal, which is fed to a circuit 22 generating an electrical signal corresponding to the detected or received sound but being of an opposite phase. This electrical signal is fed to the sound emitter 14, which generates a sound corresponding to the electrical signal, which sound is also output via the opening 12'.

The operation of the circuit 22 is to ensure that the sound output of the emitter 14 is cancelled as well as possible.

Another possible position of the sound receiver 20 is illustrated at the position 20', where the receiver 20' receives sound from the opening 12'. In this manner, the actual noise present in the ear canal of the user is detected, and a corresponding signal is fed to the emitter 14 in for the noise detected to be cancelled out. This may be performed by comparing, in the circuit or Digital Signal Processor (DSP) 22', the sound detected by the detector 20' with the desired sound, which is defined by the first electrical signal received from the cable 18, and any discrepancies therebetween may be counteracted by the DSP 22'.

Noise cancellation is a well-known art in which a signal is sought to be output which corresponds to the noise in order to provide a mixed sound signal (noise and corresponding signal) which, as well as possible, cancels out.

One manner of obtaining noise cancellation is to determine one or more prevalent frequencies therein, as well as the amplitude or sound level thereof (at the person), and to generate a signal comprising the same frequency/ies but phase shifted 180 degrees and with a level cancelling out such frequency/ies. Naturally, this is a dynamic process, as the frequency and phase as well as the sound level of noise sources, such as drills, hammers, traffic, music, engines, may shift either due to non-constant operation thereof or due to the person using the present invention moves in relation thereto. Thus, the adaptation of the second signal preferably is a dynamic process.

The sound emitter may comprise any type of sound emitter, such as a typical hearing aid receiver or a loudspeaker. Typical hearing aid receivers may be based on the moving armature, moving coil or, balanced armature, electrostatic ribbon technologies, or the like. In addition, depending on the desired use of the sound provider, sound emitters for use in mobile telephones or larger loudspeakers may be used.

In addition, the sound receiver may comprise any type of sound receiver, such as an electret microphone, Silicon microphone, moving coil dynamic microphone, piezo electric or any microphone based on the same technologies as are mentioned in relation to sound emitters.

According to the invention, the first sound emitter (e.g., 16) is adapted to output a sound corresponding to the first electrical signal. This may be any type of sound, such as music, speech or the like. This electrical signal is received from, for example, a cable (e.g., 18), another sound receiver, or the like. The terminals, thus, are adapted to receive the signal, such as by forming part of a plug adapted to engage another plug, or by being soldered to a cable, such as cable 18. Alternatively, the signal may be received from a wireless (e.g., Bluetooth® or other frequency-hopping spread spectrum technology, radio frequency (RF), or infrared) connection, such as if the system forms part of a headset. A large number of manners of obtaining operational contact to an element providing an electrical signal are known. Naturally, this signal may be converted, amplified, and/or filtered, or the like, before being transmitted to the first sound emitter.

The second sound emitter (e.g., 14) is adapted to output a sound corresponding to the sound detected/received by the sound receiver (e.g., 20). Naturally, before being converted into sound in the second sound emitter, the second signal may be converted, amplified and/or filtered, or the like, before being transmitted to the second sound emitter (e.g., 14). In one embodiment, each frequency (or each frequency with an intensity higher than a threshold) of the sound received by the sound receiver is provided in the second signal with an inverted phase so that the sound output of the second sound emitter is in counter-phase with the sound received in order to have the two sound cancel out.

In one embodiment, the sound provider 10 comprises a housing 12 with first and second sound emitters (e.g., 16, 14) being positioned so as to output sound from the housing, and the sound receiver being positioned so as to receive sound from a vicinity of the housing. In this context, the housing is a portable element, normally used for engaging the person's ear or being worn or carried by the person, such as a headset, hearing aid, headphones, or the like. Normally, the sound provider in this context weighs less than 1 kg, such as less than 500 g, preferably less than 100 g, such as less than 25 g, depending on the actual purpose thereof.

In particular, the housing 12 has a first part and a second part, the first part being adapted to face the ear canal of the person and the second part being adapted to face the surroundings of the person. The first part comprises a sound output, such as opening 12', for outputting the sound from the first sound emitter 16 and second sound emitter 14. The second part comprises an opening for receiving sound for reception by the sound receiver 20. Thus, the first part may be adapted to be introduced close to or inside the ear canal of a person. In this manner, the sound provided to the ear canal may be a combination of the sound of the surroundings and sound generated from the first signal.

This has an advantage when the surroundings have one or more noise sources which prevent or make difficult the hearing of the sound from the first sound emitter 16. Then, the second electrical signal could be made to have the sound from the second sound emitter 14 cancel at least part of the noise.

In another embodiment, the housing 12 has a first part and a second part, the first part being adapted to face the ear canal of the person and the second part being adapted to face the surroundings of the person, the first part comprising a sound output for outputting the sound from the first and second sound emitters and an opening for receiving sound for reception of the sound receiver. Naturally, the receiving opening and the emitting opening may be the same opening in the housing in order to, for example, facilitate production thereof.

In this situation, the sound detected by the receiver may be compared to that of the first electrical signal in order to determine an undesired signal (i.e., noise) which may then be converted into the second signal and fed to the second emitter in order to cancel out the sound (e.g., the undesired signal).

In general, one manner of obtaining noise cancellation is to have the sound provider comprise a circuit operatively connected to the sound receiver for providing the second electrical signal as a signal with a phase opposite to a phase of the detected sound.

In general, a circuit adapted to receive the signal from the sound receiver and providing the second signal to the second sound emitter preferably is adapted to dynamically analyze the signal from the sound receiver in order to adapt the second signal to the sound received.

Noise cancellation has been known for many years, and different manners and algorithms exist for generating the second signal. Therefore, this will not be described in detail.

Each of the above-described aspects and obvious variations thereof is contemplated as falling within the spirit and scope of the concepts which are set forth in the following claims. For example, the ear plug 10 may comprise a plurality of receivers (e.g., 20 and 20') and associated circuits or DSPs (e.g., 22, 22') disposed to process sounds in the ear canal or outside of the ear canal, such plurality of receivers and associated circuits being tuned to respond to different frequency ranges from one another and to respectively output electric signals associated with such different frequency ranges. Such plurality of receivers and associated circuits or DSPs may be associated with a respective plurality of sound emitters 14.

What is claimed is:

1. A sound provider for providing sound to a person's ear, the provider comprising:

one or more terminals for receiving a first electrical signal associated with a desired sound;

a first sound emitter operatively connected to the one or more terminals for outputting a sound corresponding to the first electrical signal;

a sound receiver for receiving only an undesirable sound and outputting a corresponding, second, electrical signal, and a second sound emitter operatively connected to the sound receiver for outputting a noise cancellation sound corresponding to the second electrical signal to cancel the undesirable sound.

2. A sound provider according to claim 1, further comprising a housing, the first and second sound emitters being positioned so as to output the sound from the housing, and the sound receiver being positioned so as to receive sound from a vicinity of the housing.

3. A sound provider according to claim 2, wherein the housing has a first part and a second part, the first part being adapted to face the ear canal of the person and the second part being adapted to face the surroundings of the person, the first part comprising a sound output for outputting the sound from the first and second sound emitters, and the second part comprising an opening for receiving sound for reception of the sound receiver.

4. A sound provider according to claim 2, wherein the housing has a first part and a second part, the first part being adapted to face the ear canal of the person and the second part being adapted to face the surroundings of the person, the first part comprising a sound output for outputting the sound from the first and second sound emitters and an opening for receiving sound for reception of the sound receiver.

5. A sound provider according to claim 1, further comprising:

a circuit operatively connected to the sound receiver for providing the second electrical signal as a signal with a phase opposite to a phase of the undesired sound.

6. The sound provider according to claim 1, wherein the one or more terminals are engagable with a cable.

7. The sound provider according to claim 1, wherein the one or more terminals are engagable with a wireless device outputting the first electrical signal.

8. A method of providing filtered sound to a person's ear, the method comprising:

receiving a first electrical signal associated with a desired sound via a terminal;

outputting a sound corresponding to the first electrical signal via a first sound emitter;

receiving only an undesirable sound via a sound receiver;

outputting a corresponding, second, electrical signal to the undesirable sound; and outputting a noise cancellation sound via a second sound emitter corresponding to the second electrical signal to cancel the undesirable sound.

* * * * *